United States Patent [19]

Strzok

[11] Patent Number: 4,984,648

[45] Date of Patent: Jan. 15, 1991

[54] MOTORIZED SKIBOARD

[76] Inventor: Michael Strzok, 457 Wilson Creek Rd., Lawrenceburg, Ind. 47025

[21] Appl. No.: 288,007

[22] Filed: Dec. 21, 1988

[51] Int. Cl.[5] ..... A63C 5/08

[52] U.S. Cl. ..... 180/181; 180/9.23; 280/14.2; 305/35 EB; 440/97; 441/77

[58] Field of Search ..... 180/181, 180, 191, 186, 180/9.23, 9.24, 9.25, 315; 280/605, 14.2, 87.042; 441/77; 440/95, 96, 97, 87; 305/16, 58 R, 35 EB, 46

[56] References Cited

U.S. PATENT DOCUMENTS

| | | | |
|---|---|---|---|
| 921,823 | 5/1969 | Gays | 440/97 |
| 1,503,597 | 8/1924 | Norelius | 305/16 |
| 1,730,059 | 10/1929 | Carvin | 305/16 |
| 2,094,136 | 9/1937 | Strawn | 440/87 |
| 2,586,218 | 2/1952 | Gazda | 440/95 |
| 2,625,229 | 1/1953 | Van Voorhees | 180/181 |
| 2,706,528 | 4/1955 | Kallio | 180/5 |
| 2,885,016 | 5/1959 | Ayers | 180/315 |
| 3,146,840 | 9/1964 | Walsh | 180/190 |
| 3,376,843 | 4/1968 | Wilson | 440/96 |
| 3,509,955 | 5/1970 | Lichfield | 180/180 |
| 3,568,787 | 3/1971 | Gremerei | 180/9.24 |
| 3,575,249 | 4/1971 | Rafstakka | 180/190 |
| 3,707,199 | 12/1972 | Gorich et al. | 180/190 |
| 3,710,881 | 1/1973 | Thompson | 180/181 |
| 3,809,173 | 5/1974 | McLeod | 180/180 |
| 3,853,192 | 12/1974 | Husted | 180/181 |
| 3,964,560 | 6/1976 | Husted | 180/181 |
| 3,966,010 | 6/1976 | Shiber | 180/181 |
| 4,035,035 | 7/1977 | Husted | 180/9.64 |
| 4,073,356 | 2/1978 | Schlicht | 180/181 |
| 4,234,050 | 11/1980 | Condon | 180/190 |
| 4,307,788 | 12/1981 | Shelton | 180/181 |
| 4,600,073 | 7/1986 | Honett | 180/181 |

FOREIGN PATENT DOCUMENTS

| | | | |
|---|---|---|---|
| 682282 | 10/1939 | Fed. Rep. of Germany | 180/9.25 |
| 959743 | 4/1950 | France | 180/181 |
| 989871 | 9/1951 | France | 440/97 |
| 2592807 | 7/1987 | France | 280/14.2 |
| 118365 | 1/1927 | Switzerland | 180/181 |

*Primary Examiner*—David M. Mitchell

*Attorney, Agent, or Firm*—Wood, Herron & Evans

[57] ABSTRACT

A motorized skiboard includes a skiboard having a central opening with a drive belt mounted in said central opening and driven by a motor and encased and held in a drive belt housing. First and second foot mounts rest on said housing on either side of said motor. The first foot mount is mounted on a piano hinge and is connected to a throttle cable so that pivoting the foot mount controls the motor. The drive belt is formed from a plurality of trapezoidal linkages with pivotally attach drive bars. When the motor is moving the belt at a speed greater than the speed at which the board is moving (when the belt is propelling the skiboard) the drive bars pivot into a ground engaging position. However, when the skiboard is sliding downhill and moving faster than the speed of the belt the drive bars pivot into a non-ground engaging position permitting the board to freely slide down the slope of a hill.

6 Claims, 4 Drawing Sheets

MOTORIZED SKIBOARD

BACKGROUND OF THE INVENTION

There are a number of devices that have been used for transportation over the snow. These include skis, sleds and the like.

Many of these have been motorized. Snowmobiles are of course the most popular form of motorized snow transportation. There have also been a number of devices designed to attach to skis and sleds and the like. Some of these include Kallio U.S. Pat. No. 2,706,528, Walsh U.S. Pat. No. 3,146,840, Lichfield U.S. Pat. No. 3,509,955, Gremerei U.S. Pat. No. 3,568,787, Raistakka U.S. Pat. No. 3,757,249, Gerich U.S. Pat. No. 3,707,199.

A power ski device is disclosed for example in Thompson U.S. Pat. No. 3,710,888. A backpack propelling device is disclosed in McLeod U.S. Pat. No. 3,809,173. Other ski mounted devices include Husted U.S. Pat. No. 3,853,192, Husted U.S. Pat. No. 3,964,560, Shiber U.S. Pat. No. 3,966,010, and Husted U.S. Pat. No. 4,035,035. Snowmobile type devices are disclosed for example in Condon U.S. Pat. No. 4,234,050 and Shelton U.S. Pat. No. 4,307,788. Most of these snowmobile type devices include drive belts which are cleated in some way or corrugated to provide a snow engaging or ground engaging surface. Since they are corrugated they do not slide over the ground but are merely a form of propulsion. Husted U.S. Pat. No. 3,964,560 discloses an endless belt that has a plurality of inwardly projecting spokes that engage the ground at an angle and are described as automatically disengaging from the snow and flatten out against the belt during a powerless skiing mode. However, these do not provide the action of a drive cleat engaging the snow. Further, these can easily become bound with snow and provide little positive traction.

These devices which either mount to skis generally require hand control of the throttle. This can be particularly inconvenient and does not permit the rider full use of his arms to assist in balancing.

SUMMARY OF THE INVENTION

It is an object of the present invention to provide a motorized belt drive skiboard wherein the throttle means for the belt drive is controlled by a pivotally mounted foot mount supported on the board and preferably on a belt housing above the board.

It is further an object of the present invention to provide such a board with an endless belt which has ground engaging cleats which engage the ground when the belt is being propelled at a speed greater than the speed of the board and which disengage the ground and freely slide along the ground when the board is moving at a speed faster than the speed of the belt.

The objects and advantages of the present invention will be further appreciated in light of the following detailed description and drawings wherein:

Figure 2:
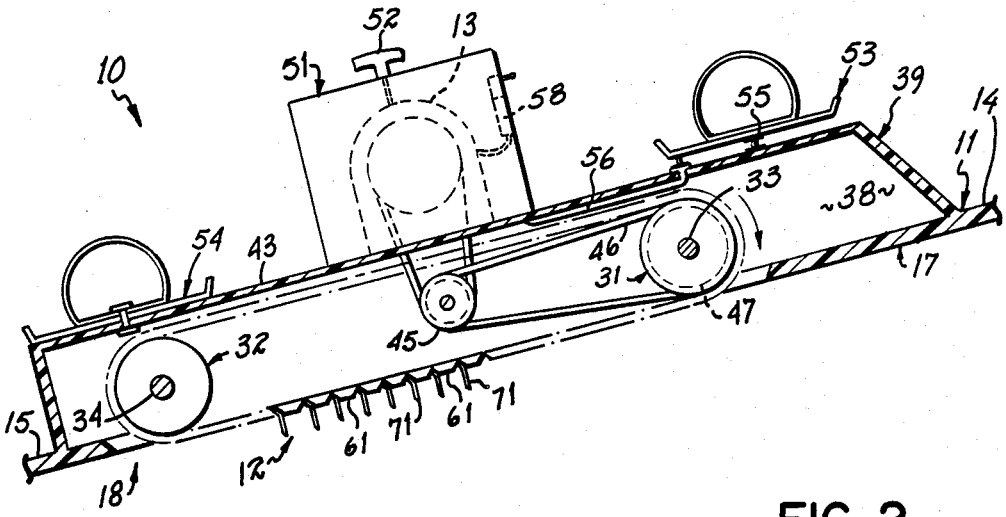
FIG. 2 is a cross-sectional view taken at lines 2—2 of FIG. 1 showing the board being driven up an incline.
Figure 3:
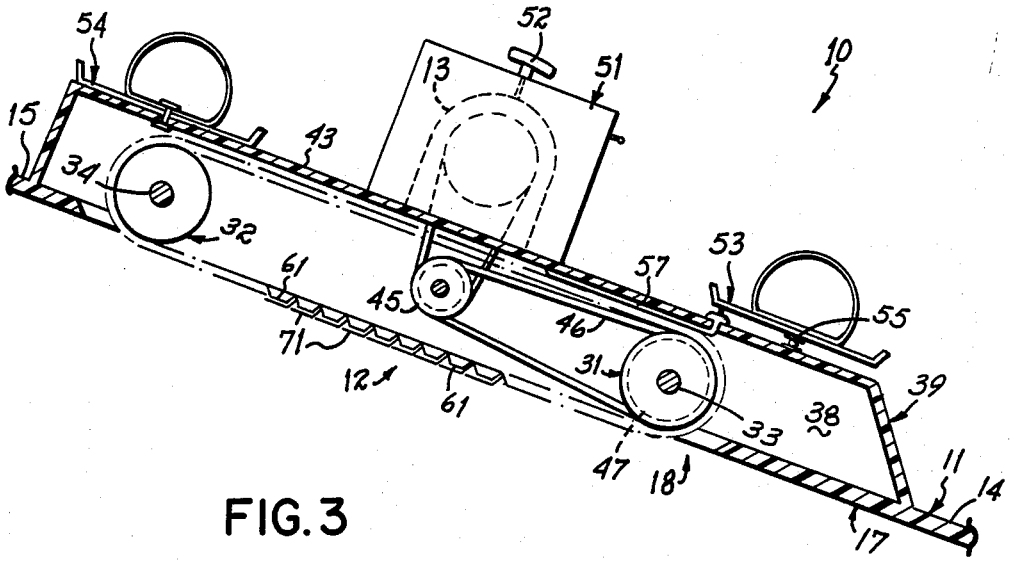
FIG. 3 is a cross-sectional view taken at lines 2—2 of FIG. 1 wherein the belt is in a sliding position moving down an incline.

The skiboard of the present invention 10 includes a board member 11, a drive belt 12 which is driven by a motor 13 shown as dotted lines on FIGS. 2 and 3.

Board 11 includes a front portion 14, rear portion 15 as well as a top plane 16 and a bottom plane 17.

Figure 4:
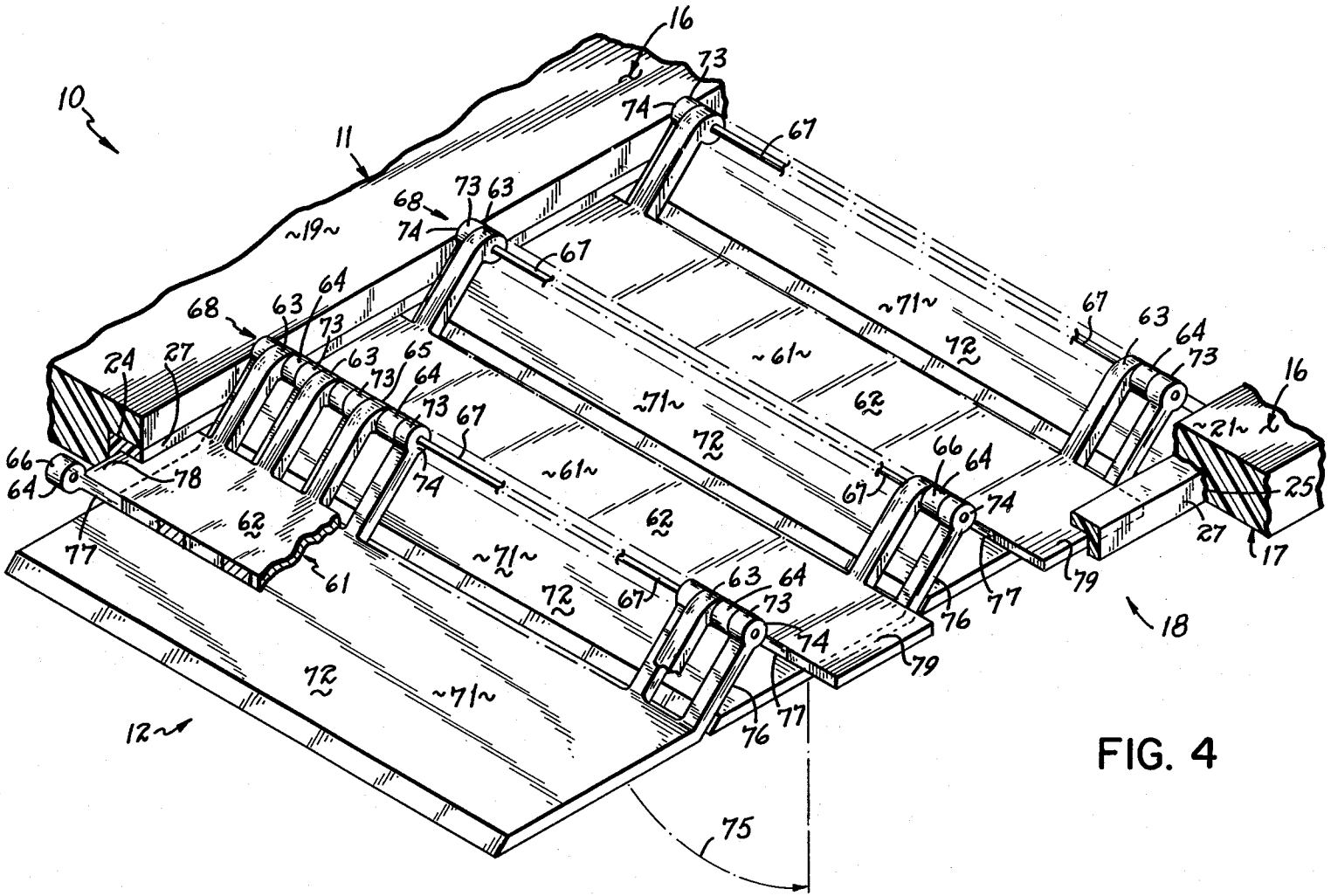
FIG. 4 is a perspective view partially broken away of the drive belt of the present invention.
Figure 5:
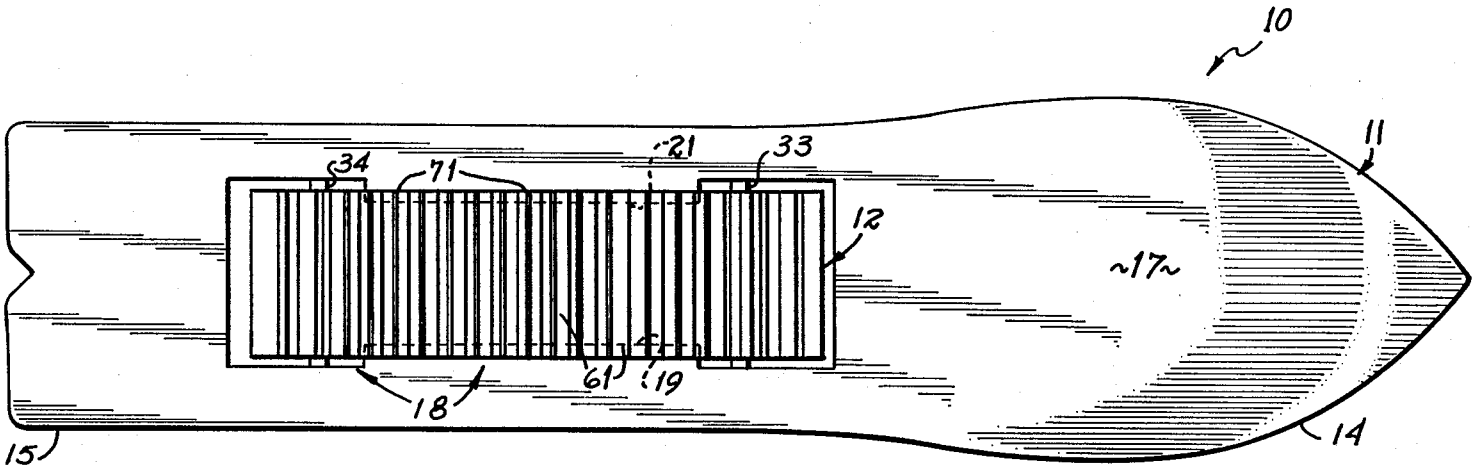
FIG. 5 is a bottom view of the board according to the present invention wherein the drive bars are in a ground engaging position.

As shown in FIG. 5, the board 11 also includes a centrally located opening 18. The opening includes first and second ledge portions 19 and 21 leaving a front and a rear enlarged portions 22 and 23, respectively. As shown more particularly in FIG. 4, the ledge portions 19 and 21 include a first and second groove 24 and 25 which extends inwardly from the bottom plane towards the top plane of the board. Fixed within these grooves 24 and 25 are friction reducing (Teflon ) inserts 26 and 27. These inserts are angled pieces of friction reducing material generally Teflon brand polytetrafluoroethylene having a L-shaped cross-section.

Figure 1:
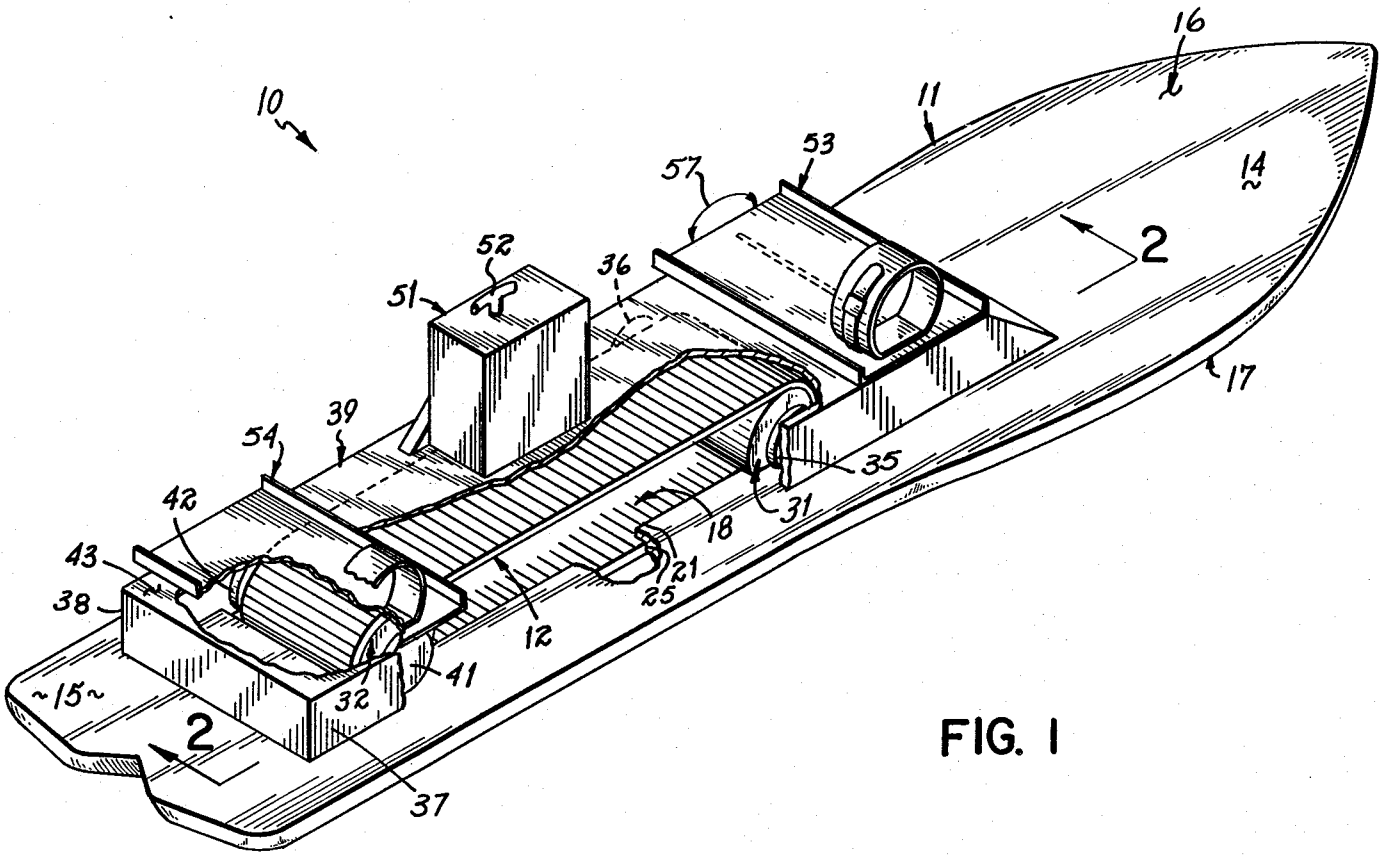
FIG. 1 is a perspective view partially broken away of a motorized skiboard made according to the present invention.

The board is driven by the drive belt 12 powered by motor 13. As shown more particularly in FIGS. 2 and 3, the belt runs between first pulley 31 and second pulley 32. First pulley 31 acts as a drive pulley whereas the second pulley 32 acts as an idle pulley. Running through first and second pulleys 31 and 32 are first and second axles 33 and 34. Axle 33 runs between a pair of flanged bearings 35 and 36 (see FIG. 1). Flanged bearings 35 and 36 mount in sidewalls 37 and 38 of the belt housing 39.

Axle 34 likewise runs between first and second flange bearings 41 and 42 which are likewise mounted on first and second sidewalls 37 and 38 of the belt housing 39.

Belt housing 39 also includes a top wall 43 which substantially covers the entire belt. The motor 13 is mounted on this top wall 43 of the belt housing 39. Extending through the top wall is a first belt 44 which extends from the motor 13 to a first sprocket 20 of a first pulley 45 mounted on sidewall 38 of the belt housing centered even with the first and second axle. A second belt 46 extends from the first pulley 45 and extends to a pulley 47 which is fixed to and rotates with axle 33.

The motor 13 is encased with a motor housing 51. The motor 13 can be activated by a variety of different mechanisms and preferably a pull cord shown by handle 52 will act to operate the motor. The motor includes a centrifugal clutch not shown which will activate the belt 44 thereby driving axle 33 and drive belt 12. Mounted to the top wall of the belt housing are first and second foot mounts 53 and 54. These are basically ski bindings. Second foot mount 54 is fixedly mounted to the top wall 43. The first foot mount 53 is mounted to the forward portion of the top wall 43 on a piano hinge 55. Piano hinge 55 permits the foot mount to pivot at the piano hinge 55. A throttle cord 56 engages the bottom surface of the first foot mount 53 so that upon pivoting the foot mount in the direction of arrow 57 presses in on the throttle providing extra gas to the motor causing operation of the board. Pivoting the foot mount 53 in the opposite direction would reduce gas flow to the engine and prevent drive belt 12 from being powered. Preferably the motor also includes a mercury type tilt switch 58 which will ground the motor and stop it should the board tip over.

The drive belt 12 extends around the first and second pulleys 31 and 32. The drive belt 12 extends below the plane of the board at the first enlarged opening or front enlarged opening 22 and extends above the plane of the board through rear enlarged portion 23. Between the enlarged portions 22 and 23 the belt rides on ledge 19 and 21 in contact with friction reducing inserts 26 and 27.

As shown in FIG. 4, the belt preferably has a very unique design including a plurality of trapezoidal links 61. Trapezoidal links include a flat bar-like planar land portions 62 which extend across the width of the belt and a plurality of upwardly forwardly extending arms 63 and a plurality of rearwardly upwardly extending arms 64. The forwardly extending arms 63 terminate at eyelets 65. And likewise the rearwardly extending arms 64 terminate in eyelets 66. A linkage 68 is formed by a link pin 67 which extends through the eyelets 65 and 66 of consecutive links. This allows for relative rotation of adjacent links.

Also connected to the drive belt at the linkages 68 are a plurality of drive bars 71. One drive bar 71 attaches at each of said linkages 68. The drive bar 71 includes a planar bar portion 72 which is basically co-extensive with the flat portion 62 of links 61. The drive bars also include a plurality of upwardly forwardly extending arms 73 which terminate in eyelets 74. The drive bars 71 are attached to the drive belt at the linkages 68 engaged with the link pins 67 through eyelet 74. Thus, a linkage 68 will include the eyelets from a forward link 63, arms from a rearward link 64 and forward arms 73 from the drive bar 71 all of which are hingedly attached to permit rotation of the individual links 61 as well as the drive bars 71. Since the forward and rear arms of the links are sloped as shown in FIG. 4 the drive bar 71 is provided with a degree of rotation shown by arrow 75 which permits the bar to ride immediately adjacent the land portions of the trapezoidal links resting on the land portions. This would be in a non-ground engaging position. The drive bars can also rotate approximately 90° as shown by arrow 75 into a ground engaging position. In this ground engaging position the forward edge 76 of the drive bar 71 would be engaged with the rearward edge 77 of trapezoidal links 61.

Pulleys 31 and 32 should have a surface adapted to receive the individual links 61 of the drive belt. This surface configuration is not shown but would be a complementary surface to the links.

The land portion 62 of links 61 include distal edge portion 78 and 79 which extend beyond the width of the forward and rearward arms 63 and 64 and which engage and ride in the friction reducing insert 26 and 27 respectively. The drive bar does not extend the entire width of the land portion 62.

In operation the rider will stand on the skiboard 10 with feet resting in feet mounts 53 and 54 the motor 13 resting between his feet. The motor will be activated for example by pulling pull cord 52. The rider will then pivot foot mount 53 at piano hinge 55 causing the motor to accelerate. This will cause a centrifugal clutch to engage and rotate first belt 44 in turn rotating the pulley 45. This will cause the second belt 46 to rotate in turn rotating 47 which in turn rotates the first axle 33 and first pulley 31.

Rotation of first pulley 31 will cause the drive belt 12 to rotate. The drive bars 71 will engage the ground upon rotation and pivot in the direction of arrow 75 engaging the ground or preferably the snow. These will be at a 90° angle causing the skiboard to move forwardly. These will remain in a ground engaging position until reaching the second pulley 32 at which time as the belt rotates around pulley 32 the pins will rotate back into the opposite direction.

It may be preferable to provide sufficient clearance above the drive belt to provide clearance for the drive bars should they not rotate back into a non-engaged position as they pass at the upper run of the belt. Should snow or other material fall between the drive bar and the land portions of the link this may prevent temporary rotation of the bars.

Once it is desired to permit gravity to take over and slide down a hill as shown in FIG. 3 the foot mount 53 is pivoted in an opposite direction to disengage throttle 56. The belt will then either stop moving or rotate at a speed slower than the board. This will force the drive bars into a non-ground engaging position with the planar bar portion 72 resting against the bottom of land portion 62 of the link 61.

Thus, according to the present invention the rider of a motorized skiboard made according to the present invention could operate the skiboard totally without use of the hands. This would free the hands to permit them to assist the rider in remaining balanced atop the skiboard. With the motor centered between the individual foot mounts the balance of the board remains at about the center of the board which further assists in balancing.

Further, the drive belt has a configuration that when in a driving mode very firmly grasps the snow providing an extremely good positive traction which cannot easily be clogged with snow and inactivated. Further due to the configuration of the drive belt the drive belt can be in a non-ground engaging position so that the rider of the skiboard can slide down the slope of a hill at a speed substantially faster than the speed the drive belt could go.

Should the driver tilt the board over the tilt switch would cause the motor to be disengaged regardless of the position of the throttle 52.

This has been a description of the present invention along with the preferred mode of practicing the invention currently known. However, the invention should be defined only by the appended claims wherein

I claim:

1. A motorized skiboard comprising a skiboard having a top plane, a bottom plane and a central opening extending through said top plane and bottom plane, a motor drive belt, drive belt mounting means mounting said drive belt centered relative to said opening a throttle means adapted to control said motor;

said drive belt including a plurality of drive bars, pivotally mounted to said belt whereby said belt is mounted relative to the board so that said drive bars extend beyond the bottom plane of the board when in ground engaging position and ride at the bottom plane of the board when in a sliding position;

wherein said drive belt comprises a plurality of trapezoidal links, each trapezoidal link having a downwardly extending arm and a land portion and an upwardly extending arm and said drive bars having a planar portion and a plurality of vertically inclined arm portions pivotally attached to said trapezoidal links whereby when said drive bars are in a sliding position said arm portions of said drive bars are parallel to the downwardly extending arm portions of said trapezoidal links and said planar portion of said drive bars are parallel to and resting against said land portion of said trapezoidal link; and whereby when said drive bar is in a ground engaging position said planar portion is perpendicular to the land portion of said trapezoidal links.

2. The motorized skiboard claimed in claim 1 further comprising a first and a second foot mount, said first foot mount pivotally attached to said board, said throttle means having a throttle cable running between said motor and said first foot mount whereby pivoting said first foot mount moves said throttle cable and operatively controls said motor.

3. The skiboard claimed in claim 1 further comprising a tilt switch adapted to shut off said motor.

4. The skiboard claimed in claim 2 further comprising a belt housing wherein said first and second foot mounts rests on said belt housing.

5. The skiboard claimed in claim 4 wherein said motor is mounted on said belt housing between said first and second foot mounts.

6. A motorized skiboard comprising a skiboard having a top plane, a bottom plane and a central opening, a motor driving a drive belt, drive belt mounting means mounting said drive belt centered relative to said central opening, a belt housing, said motor mounted on said belt housing, first and second foot mounts mounted to said belt housing on either side of said motor, said first mount pivotally attached to said belt housing, a throttle means comprising a throttle cable connecting said motor with said first foot mount whereby pivoting said first foot mount moves said throttle cable and controls said motor, said drive belt comprising a plurality of trapezoidal links joined at a plurality of linkages and a plurality of drive bars, said drive bars having planar portions and a plurality of vertically inclined arm portions pivotally mounted to said belt at said linkages whereby said belt is mounted relative to said board so that said drive bars extend beyond the bottom plane of the board when in a ground engaging position and ride at about the bottom plane of the board when in a non-ground engaging position.

* * * * *